US005156341A

United States Patent [19]

Terakado et al.

[11] Patent Number: 5,156,341

[45] Date of Patent: Oct. 20, 1992

[54] ELECTROMAGNETIC TYPE FUEL INJECTION VALVE

[75] Inventors: Katsuyoshi Terakado, Ibaraki; Hisanobu Kanamaru; Mizuho Yokoyama, both of Katsuta; Tokuo Kosuge, Ibaraki, all of Japan

[73] Assignee: Hitachi, Ltd., Tokyo, Japan

[21] Appl. No.: 361,285

[22] Filed: Jun. 5, 1989

[30] Foreign Application Priority Data

Jun. 8, 1988 [JP] Japan ..... 63-139312

[51] Int. Cl.[5] ..... B05B 1/30

[52] U.S. Cl. ..... 239/585.4; 239/900

[58] Field of Search ..... 239/585; 29/890.122; 251/129.15, 129.01

[56] References Cited

U.S. PATENT DOCUMENTS

| | | | |
|---|---|---|---|
| 4,245,789 | 1/1981 | Gray | 239/585 |
| 4,264,040 | 4/1981 | Saito | 239/585 |
| 4,360,164 | 11/1982 | Bellicardi et al. | 239/585 |
| 4,394,973 | 7/1983 | Sauer et al. | 239/585 X |
| 4,651,926 | 3/1987 | Sasao et al. | 239/585 |

FOREIGN PATENT DOCUMENTS

| | | |
|---|---|---|
| 0177719 | 8/1985 | European Pat. Off. . |
| 0232475 | 11/1986 | European Pat. Off. . |
| 2197053 | 5/1988 | United Kingdom . |

OTHER PUBLICATIONS

*Design Engineering* May, 1989, p. 16 London GB "Soft Magnetic Stainless Steel for Electric Fuel Injector".

*Primary Examiner*—Andres Kashnikow
*Assistant Examiner*—Kevin P. Weldon
*Attorney, Agent, or Firm*—Antonelli, Terry Stout & Kraus

[57] ABSTRACT

Disclosed is an electromagnetic type fuel injection valve including a stator iron core, an electromagnetic coil concentric with the stator iron core, a casing formed of a magnetizable material and accommodating therein the stator iron core and the electromagnetic coil, a moving body provided at its end with a valve body, a stopper for the moving body, a valve seat opposite to the stopper with the moving body interposed therebetween and a spring engaged with an end of the moving body for biasing the same, the moving body being adapted to reciprocate between the valve seat and the stator iron core under the magnetizing force of the electromagnetic coil and the biasing force of the spring, and having an armature adapted to be absorbed by the stator iron core and a rod contiguous with the valve body, the armature and the rod being formed of the same material so as to be integral with each other, a guide portion of the rod and a portion of the moving body adapted to abut against the stopper being subjected to a hardening treatment, and the electromagnetic absorbing force of the armature being increased by reducing the leak magnetic flux leaking through the rod.

13 Claims, 4 Drawing Sheets

ELECTROMAGNETIC TYPE FUEL INJECTION VALVE

BACKGROUND OF THE INVENTION

This invention relates to an electromagnetic type fuel injection valve, and in particular, to an electromagnetic type fuel injection valve suitable for use as a fuel injection valve in an automotive fuel supply system.

As disclosed, for example, in Japanese Patent Examined Publication No. 56-11071, this type of electromagnetic fuel injection valve comprises a stator iron core made of a magnetic material and including a flange section, a casing made of a magnetic material, an electromagnetic coil surrounded by this casing, a moving body, and a needle valve. When an electric current is passed through the electromagnetic coil, a magnetic circuit is formed, the electromagnetic force thus formed urging the moving body to open and close the needle valve. The moving body, that is, a principal component, is composed of an armature, a rod, and a valve body. The valve body is required to have abrasion resistance and corrosion resistance since it hits against a valve guide in the fuel pasage. In view of this, the valve body is normally made of a high-carbon (C) and high-chrome (Cr) martensite base stainless steel of JIS SUS440C class, which is hardened and tempered to give it a Rockwell hardness of around Hrc60. Since the rod of the moving body hits against a stopper, the rod also needs to have abrasion resistance and corrosion resistance, so it is made of a material of the same type as the valve body. The valve body and the rod are connected to each other by means of electric resistance welding, laser welding, plasma welding, electron beam welding, etc.

Since the armature of the moving body forms a magnetic circuit together with the stator iron core and the casing, its material is a low-carbon and high-chrome electromagnetic stainless steel containing silicon which is of the same type as is used for the stator iron core and the casing. That is, the armature is normally worked into a ring-like configuration by means of a lathe, and is annealed at a temperature in the range of 900° to 1100° C. to remove therefrom internal strain and internal residual stress, its crystal grain size being enlarged so that it possesses the desired electromagnetic properties. Afterwards, it is connected to the rod by means of laser welding, electron beam welding, force fitting, press fitting or the like. This connecting operation results in considerable generation of strain and residual stress in the armature, thereby causing a deterioration in the magnetic properties (coercive force and magnetic flux density). On the other hand, the exciting force that serves as the absorbing force of the armature creates a leakage magnetic path leading to the casing through the rod which constitutes the needle valve and the valve guide which constitutes the nozzle body. Accordingly, the rod is subjected to absorption around and suffers abrasion while moving in the vertical direction. Hence the absorbing force needs to be reduced and the abrasion resistance of the rod enhanced. In a case where the armature is connected to the rod by means of press fitting as disclosed in Japanese Patent Examined Publication No. 56-11071, the joint section is inevitably made long so that the predetermined degree of binding strength can be obtained.

SUMMARY OF THE INVENTION

The object of this invention is to eliminate the above-mentioned problems experienced with the prior art.

In order to attain the above object, this invention provides an electromagnetic type fuel injection valve including a stator iron core, an electromagnetic coil concentric with this stator iron core, a casing made of a magnetic material and accommodating therein the stator iron core and the electromagnetic coil, a moving body provided at its end with a valve body, a stopper for this moving body, a valve seat opposite to the stopper with the moving body interposed therebetween, and a spring engaged with an end of the moving body such as to bias the same, the moving body being adapted to reciprocate between the valve seat and the stator iron core under the magnetizing force of the electromagnetic coil and the biasing force of the spring, an armature adapted to be absorbed by the stator iron core and a rod contiguous with the valve body being integrally formed from the same material, while a guide portion of the rod and a portion of the moving body which is adapted to abut against the stopper are subjected to a hardening treatment.

According to an aspect of this invention, the armature which is adapted to be absorbed by the stator iron core, the rod, and the valve body at the end of the rod are integrally formed from the same material, and the guide portion of the rod, the portion of the moving body which is adapted to abut against the stopper, and the entire valve body or a part thereof including the portion hitting against the valve seat are subjected to a hardening treatment.

In accordance with this invention, there is further provided an electromagnetic type fuel injection valve including a stator iron core, an electromagnetic coil concentric with this stator iron core, a casing made of a magnetic material and accommodating therein the stator iron core and the electromagnetic coil, a moving body provided at its end with a valve body, a stopper for this moving body, a valve seat opposite to the stopper with the moving body interposed therebetween, and a spring engaged with an end of the moving body such as to bias the same, the moving body being adapted to reciprocate between the valve seat and the stator iron core under the magnetizing force of the electromagnetic coil and the biasing force of the spring, the electromagnetic absorbing force of the armature which constitutes the moving body being increased by reducing the leak magnetic flux leaking through the rod which is contiguous with the armature.

DESCRIPTION OF THE PREFERRED EMBODIMENTS

Figure 1:
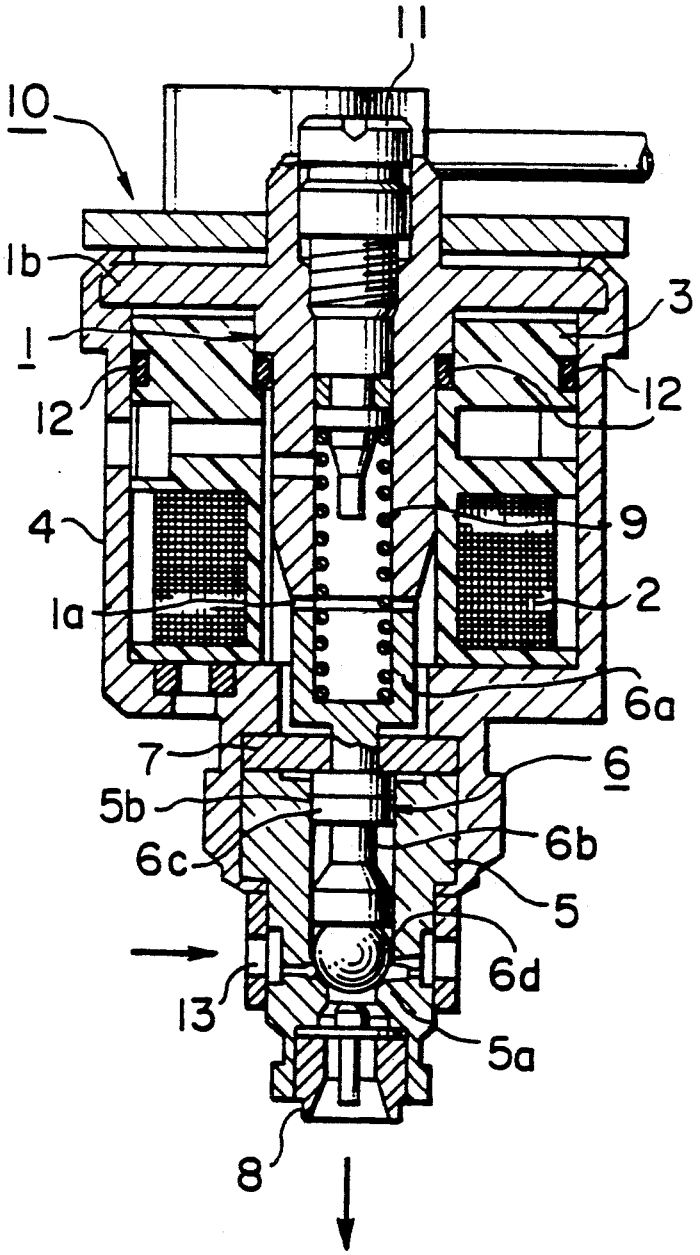
FIG. 1 is a longitudinal sectional view of an electromagnetic type fuel injection valve in accordance with a first embodiment of this invention.

FIG. 1 shows an electromagnetic type fuel injection valve 10 in accordance with the first embodiment of this invention. This fuel injection valve 10 comprises a stator iron core 1 equipped with a flange section 1*b* and having a T-like longitudinal section, an electromagnetic coil 2 surrounding this stator iron core, a plastic insulating member 3 molded around this electromagnetic coil and surrounding the stator iron core, a casing 4 made of a magnetic material, a valve guide 5 supported at the bottom of this casing, a moving body 6 whose armature 6*a* faces the lower end of the stator iron core, a stopper 7 in the form of a split washer and retained between a step section of the casing and the valve guide, a nozzle 8 supported at the bottom of the valve guide, a coil spring 9 arranged in the center hole 1*a* of the stator iron core and biasing the moving body, and an adjusting screw 11 threaded into the threaded upper section of the central hole 1*a* of the stator iron core and adapted to enable the spring load to be adjusted from the exterior. The insulating member 3 is fitted to the stator iron core 1 and the casing 4, being sealed from them by means of an oil seal 12. As shown in FIG. 1, the upper and lower ends of the casing 4 are fixed by means of caulking to the flange section lb of the stator iron core 1 and the valve guide 5, respectively.

Figure 2A:
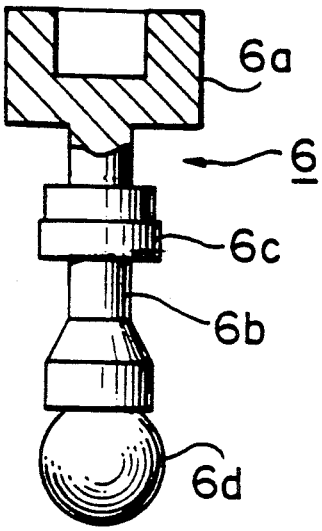
FIG. 2A is a side view, partly in section, of a moving body of the electromagnetic type fuel injection valve shown in FIG. 1.

Referring to FIG. 2, the moving body 2 comprises an armature 6*a*, a rod 6*b*, a guide portion 6*c* having a disc-like configuration, and a spherical valve body 6*d* designed to be seated on the valve seat 5*a* of the valve guide 5. The armature 6*a* faces in the casing 4 the lower end of the stator iron core 1, the guide portion 6*c* being in slidable contact with the inner peripheral surface of the center hole 5*b* of the valve guide 5. The stopper 7 is in the form of a split washer so that it may be assembled and taken apart with ease, and is adapted to abut against the guide portion 6*c* of the moving body 6 so that the latter is stopped when attracted by the stator iron core 1. The moving body 6 is constantly biased downwards by a coil spring 9, thereby seating the valve body 6*d* on the valve seat 5*a* of the valve guide 5. Only when the electromagnetic coil 2 is excited to cause the moving body 6 to be attracted by the stator iron core 1 will the valve body 6*d* be able to separate from the valve seat 5*a* of the valve guide 5, thereby causing fuel supplied through a fuel passage 13 to be ejected outwardly through the nozzle 8.

The moving body 6 is made of a material A selected from among those meeting JIS standard SUS420J2 (the type containing 0.26 to 0.40% C and 12.00 to 14.00% Cr) taking into consideration the magnetic properties, the induction heating suitability, and the corrosion resistance. The armature 6*a*, the guide portion 6*c* and rod 6*b* are integrally formed from this material by means of machining such as NC. The end surface of the guide portion 6*c* which abuts against the stopper 7 and the outer peripheral surface thereof which is in slidable contact with the inner peripheral surface of the valve guide 5 are subjected to induction heating. Then, the valve body 6*d*, which is separately prepared, is connected to the rod 6*b* by means of resistance welding, the induction-heated end surface and outer peripheral surface of the guide portion 6*c* then being cut. Finally, the end surface of the armature 6*a* is cut in order to adjust the entire length of the moving body to a predetermined dimension. The above-mentioned material A, which is annealed at a temperature ranging from, for example, 750° to 850° C., has the following magnetic properties:

| | Coercive force | Magnetic flux density | | | Specific resistance |
|---|---|---|---|---|---|
| | Hc (Oe) | B5 | B10 | Br | $\rho$(μΩcm) |
| SUS420J2 Material A | 6.0 | 1,400 | 6,500 | 8,300 | 55 |

In addition to the above magnetic properties, the above-mentioned material A must be suitable for a hardening treatment so that abrasion resistance may be imparted to the end surface of the guide portion 6*c* which is adapted to abut against the stopper 7 which acts to control the position of the moving body 6 while the valve is open. In consideration of this, the magnetic properties of the material A are such that its coercive force $Hc \leqq 25$ (Oe), more preferably $Hc \leqq 10$ (Oe), with its magnetic flux density $B_5 \geqq 500$ (G), more preferably, $B_5 \geqq 1400$ (G), $B_{10} \geqq 1500$ (G), more preferably, $B_{10} \geqq 3000$ (G), and $Br \geqq 1500$ (G), more preferably, $Br \geqq 2000$ (G). Further, the material A exhibits an electric resistance $\rho \geqq 30$ (μΩcm), more preferably, $p \geqq 50$ (μΩcm).

The hardening treatment of the above-mentioned end surface and outer peripheral surface of the guide portion 6*c* of the moving body is to be regarded sufficient when a micro-Vickers surface hardness of Hv550 or more has been imparted to the surfaces. Apart from induction heating, this treatment may be performed by means of carburizing, nitriding treatment, ceramic coating by the PVD (Physical Vapor Deposition) method or ion implantation, though induction heating is the most suited for hardening part of the moving body on a mass-production basis. In the construction shown in FIG. 1, the leak magnetic flux flows through the valve guide 5 and the guide portion 6*c* of the moving body, and causes the moving body rod 6*b* to be absorbed toward the inner periphery of the valve guide 5, thereby deteriorating the smoothness in the movement of the moving body 6. In accordance with this invention, the guide portion 6*c* of the moving body is subjected to a surface treatment in the way described above, so that the magnetic resistance is increased and the leakage magnetic flux is reduced.

In this embodiment, induction heating was employed, the above-mentioned end surface and outer peripheral surface of the moving body being heated together under a power output of 10 KV and a frequency of 200 KHz for a heating time of 0.5 sec. Immediately after heating, they were cooled, and were annealed at 160° C. for 90 minutes. It was found that the above mentioned surfaces of the moving body had a micro-Vickers hardness of Hv550 to 620 and an effective hardening depth of 1.0 mm or more, a fact indicating a sufficient abrasion resistance for their abutment against the stopper 7.

The resistance welding for connecting the valve body 6*d* to the rod 6*b* was performed using a resistance welder, with a welding current of 2.7 KA and a cycle time of 0.4 sec. The resulting weld zones exhibited a tensile strength of about 250 kg, a sufficient welding strength which is equivalent to that in the prior art.

Figure 2B:
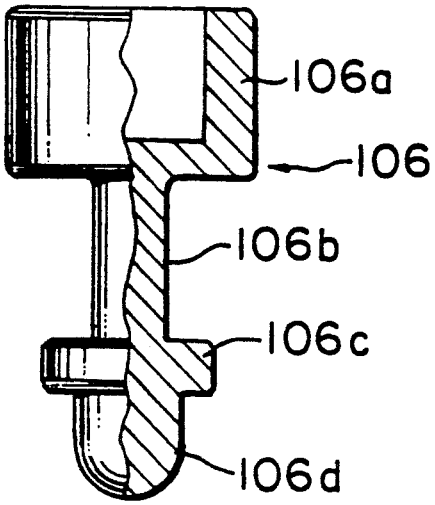
FIG. 2B is a side view, partly in section, of a moving body of a fuel injection valve in accordance with a second embodiment of this invention.

Alternatively, a moving body 106 shown in FIG. 2B may be produced in the manner described below in accordance with the second embodiment of this invention. The moving body 106 is formed by cutting, by means of an NC mechanism, a bar material whose material diameter corresponds to the finish outer diameter of the armature, integrally forming an armature 106*a*, a guide portion 106*c*, a rod 106*b* and a valve body 106*d*, with a surface roughness of 0.5 to 2.0 μm (Rmax). Next, the spherical portion of the valve body 106*d* which is adapted to abut against the valve seat 5*a* of the valve guide 5 is lapped to a surface roughness of 0.5 to 0.8 μm (RZ), a roundness of 1 μm or less, and an eccentricity of 5 μm or less. Then, the valve body 106*d* and the guide portion 106*c* which abuts against the stopper 7 are subjected to a hardening treatment using induction heating, thus producing a moving body. The hardened surfaces exhibit a micro-Vickers hardness of Hv550 to 620 and an effective hardening depth of 1.0 mm or more, a hardness experimentally ascertained to be sufficient for a valve body.

Conventionally, the valve body and the rod of the moving body have been connected to each other by means of electric resistance welding, laser welding, plasma welding, electron beam welding, etc. The material for the valve body or the rod has normally been a martensite base stainless steel of JIS SUS440C class. This type of material contains a large amount of carbon (C) and chrome (Cr), so that it is apt to involve cracks during welding. Accordingly, the above-mentioned welding methods must be performed under very narrow welding conditions so that no weld cracks may be involved. Furthermore, the above-mentioned welding methods inevitably involve welding dust and burrs, much labor being required for the removal, the after treatment and the washing thereof. Any residual welding dust and burrs might result in the fuel outlet of the fuel injection valve being clogged in service, thereby preventing the fuel injection valve to function. A moving body which consists of an armature, a guide portion, a rod and a valve body that are integrally formed by cutting in accordance with the second embodiment of this invention, not only contributes to reduction in manhours, but also effectively improves the reliability of the fuel injection valve.

Figure 3:
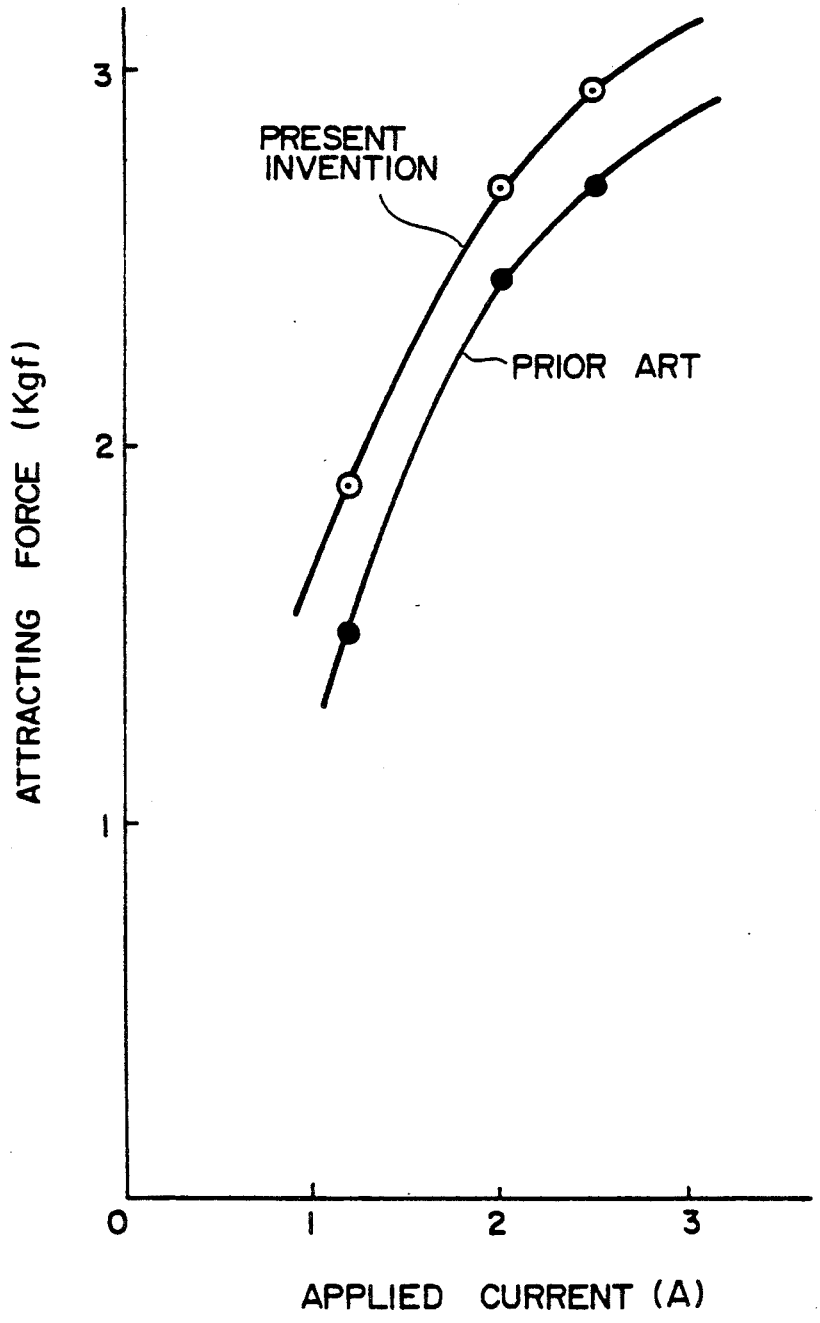
FIG. 3 is a graph showing the respective absorbing force characteristics in the electromagnetic type fuel injection valve of this invention and a conventional one.

In FIG. 3, a characteristic of the electromagnetic type fuel injection valve of this invention is compared with that of the conventional electromagnetic type fule injection valve disclosed in Japanese Patent Examined Publication No. 56-11071. The characteristic compared is the magnitude of the attracting force of the moving body with respect to the electric current applied to the electromagnetic coil, a characteristic that is most important in an electromagnetic type fuel injection valve. As shown in FIG. 3, the electromagnetic valve of this invention exhibits an attracting force which has been improved by about 20% as compared with that of the prior art electromagnetic type fuel injection valve mentioned above, a fact proving the excellent magnetic properties of the armature of the moving body in this invention. Further, an endurance test was conducted at the rate of 200 cycles per second, the cycles being repeated 100 to 300 million times. It was found through measurement of the flow rate characteristic before and after the endurance test using a cellulose having the same viscosity as automotive gasoline that the electromagnetic type fuel injection valve of this invention could provide a flow rate characteristic equivalent or superior to that of the above-mentioned conventional electromagnetic type fuel injection valve. Furthermore, practically no wear was to be observed on the end surface of the armature which abuts against the stopper 7 or on the slide surfaces of the guide portion of the moving body of this invention even after the above endurance test, a fact indicating a satisfactory abrasion resistance.

While the above-described embodiments have been shown as applied to an electromagnetic fuel injection valve of the side feed type, they are also applicable to one of the top feed type, the armature and the rod being integrally formed from the same material in accordance with this invention.

Figure 4:
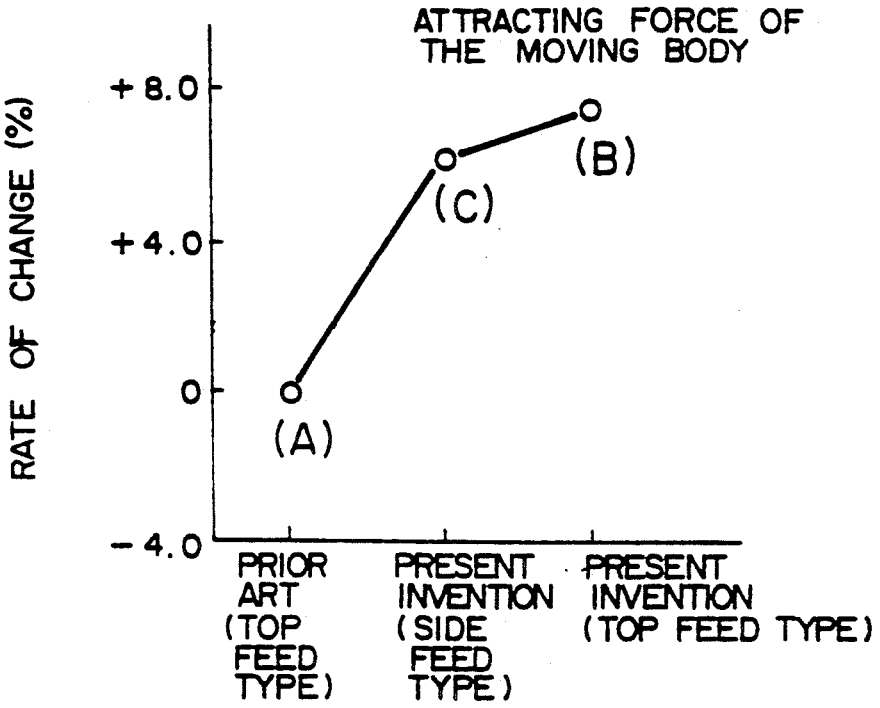
FIG. 4 is a graph showing the absorbing force characteristic of the moving body of the fuel injection valve shown in FIG. 1.
Figure 5:
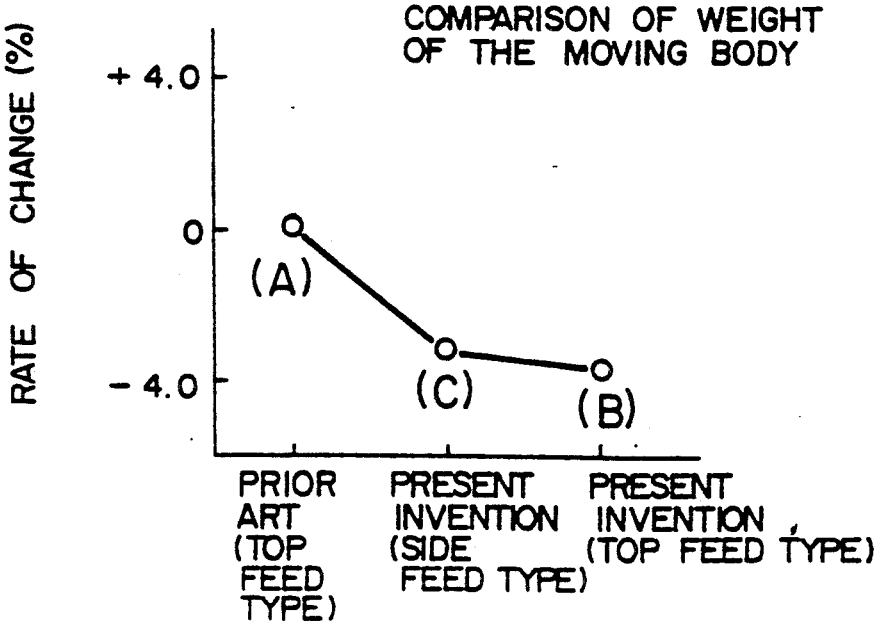
FIG. 5 is a graph in which the weights of moving bodies for the fuel injection valve shown in FIG. 1 are compared with each other.

In FIG. 4, the electromagnetic attracting force of the moving body integrally formed from the same material in accordance with this invention is compared with that of a usual moving body formed by connecting to each other an armature and a rod prepared separately. The electromagnetic fuel injection valve B of the top feed type in accordance with this invention exhibits a rate of change 7% greater than that of a usual electromagnetic valve A of the top feed type. That is, the electromagnetic type valve of this invention provides an attracting force which is equivalent to that obtained by the usual electromagnetic type valve even if its attracting area is reduced by 7%. This implies that a product with satisfactory responsiveness can be obtained while reducing the weight of the armature as shown in FIG. 5. Roughly speaking, a product which provides the same function as that of a usual electromagnetic type fuel injection valve can be realized with an armature having weight in accordance with the reduction in the attraction area of the armature. In addition, the guide portion of the moving body is subjected to a surface treatment in the manner described above to reduce the leakage magnetic flux flowing through the valve guide and the guide portion of the moving body, so that, apart from the above-mentioned reduction in weight, the responsiveness of the moving body itself is improved to a remarkable degree.

The moving body is made of a material which exhibits a good suitability for a cutting operation using an NC mechanism as well as satisfactory magnetic properties, and hardening treatment is only performed on those sections, of which abrasion resistance is required, thus providing an electromagnetic type fuel injection valve with the desired function.

While this invention has been described as related to specific embodiments, it is to be understood that the invention is not limited to these embodiments except as defined in the appended claims.

What is claimed is:

1. In an electromagnetic type fuel injection valve comprising a stator iron core, an electromagnetic coil concentric with said stator iron core, a casing formed of a magnetizable material and accommodating therein said stator iron core and said electromagnetic coil, a moving body including a rod provided at one end with an armature and at the other end with a valve body and having a guide portion disposed between said armature and said valve body, a stopper for limiting movement of said moving body in one axial direction thereof by engagement with a portion of said moving body disposed intermediate the ends thereof, a valve seat spaced from said stopper with a portion of said moving body interposed therebetween and a spring engaged with said one end of said moving body for biasing the same toward said valve seat, said moving body being positioned to reciprocate between said valve seat and said stator iron core under the magnetizing force of said electromagnetic coil and the biasing force of said spring, said armature and said rod being formed of the same material and being integral with each other, and wherein said guide portion of said rod and a portion of said moving body which is adapted to abut against said stopper are subjected to a hardening treatment.

2. An electromagnetic type fuel injection valve as claimed in claim 1, wherein the rod and the armature of said moving body are made of a magnetic material whose composition is such that $C \leqq 1.5\%$, $5\% \leqq Cr \leqq 20\%$, and $0.1\% \leqq Si \leqq 5\%$.

3. An electromagnetic type fuel injection valve as claimed in claim 1 or 2, wherein said moving body is made of a magnetic material whose magnetic properties are such that the coercive force $Hc \leqq 25$ (Oe), the magnetic flux density $B_5 \geqq 500$ (G), $B_{10} \geqq 1500$ (G), and $Br \geqq 1000$ (G), and whose electric resistance $\rho \geqq 30$ ($\mu\Omega$).

4. An electromagnetic type fuel injection valve as claimed in claim 1, wherein the armature which is adapted to be attracted by said electromagnetic coil toward said stator iron core, said rod, and the valve body at the end of said rod are integrally formed from the same material, and wherein the guide portion of said rod, the portion of the moving body which is adapted to abut against said stopper, and at least a part of said valve body including the portion hitting against the valve seat are subjected to a hardening treatment.

5. An electromagnetic type fuel injection valve as claimed in claim 1, 2 or 4, wherein the hardening treatment is performed by means of induction heating.

6. An electromagnetic type fuel injection valve as claimed in claim 1, 2 or 4, wherein the hardening treatment is performed by means of carburizing.

7. An electromagnetic type fuel injection valve as claimed in claim 1, 2 or 4, wherein the hardening treatment is performed by means of nitriding treatment.

8. An electromagnetic type fuel injection valve as claimed in claim 1, wherein said electromagnetic type fuel injection valve is of the top feed type.

9. An electromagnetic type fuel injection valve as claimed in claim 1, wherein said electromagnetic type fuel injection valve is of the side feed type.

10. An electromagnetic type fuel injection valve as claimed in claim 1, further comprising a valve guide, said stopper being fixed with respect to said casing by means of said valve guide.

11. An electromagnetic type injection valve as claimed in claim 1, wherein said rod is subjected to hardening treatment so as to reduce the leakage magnetic flux leaking through the rod from said armature, whereby the electromagnetic attracting force of the armature is increased.

12. In an electromagnetic type fuel injection valve comprising a stator iron core, an electromagnetic coil concentric with said stator iron core, a casing formed of a magnetizable material and accommodating therein said stator iron core and said electromagnetic coil, a moving body including a rod provided at one end with an armature and at the other end with a valve body, a stopper for limiting the movement of said moving body in one axial direction thereof, a valve seat spaced from said stopper with a portion of said moving body interposed therebetween and a spring engaged with said one end of said moving body for biasing the same, said moving body being positioned to reciprocate between said valve seat and said stator iron core under the magnetizing force of said electromagnetic coil and the biasing force of said spring, wherein said rod is subjected to hardening treatment so that the electromagnetic attracting force of the armature which constitutes part of said moving body is increased by said hardening treatment of said rod, which reduces the leakage magnetic flux leaking through the rod from said armature.

13. An electromagnetic type fuel injection valve as claimed in claim 12, further comprising a valve guide, said stopper being fixed with respect to said casing by means of said valve guide.

* * * * *